United States Patent [19]

Kahler

[11] 4,134,410

[45] Jan. 16, 1979

[54] LIQUID-FILTERED SMOKING DEVICE HAVING LIQUID-SURGE PREVENTING MEANS INCORPORATED THEREIN

[76] Inventor: Richard W. Kahler, Rt. 1, Box 61, Rock Cave, W. Va. 26234

[21] Appl. No.: 759,482

[22] Filed: Jan. 14, 1977

[51] Int. Cl.[2] ..... A24F 1/30

[52] U.S. Cl. ..... 131/173; 131/180; 131/212 A; 131/215 B

[58] Field of Search ..... 131/173, 215 B, 212 A, 131/195, 214, 180, 216, 210, 212 R, 213, 216, 215 R, 218

[56] References Cited

U.S. PATENT DOCUMENTS

| | | | |
|---|---|---|---|
| 1,249,984 | 12/1917 | Meissner | 131/173 |
| 3,057,362 | 10/1962 | Flint | 131/215 B |
| 3,872,872 | 3/1975 | Kahler | 131/221 |
| 3,877,470 | 4/1975 | Jewett et al. | 131/212 A |
| 4,031,905 | 6/1977 | Dunn | 131/173 |

*Primary Examiner*—Robert W. Michell

*Assistant Examiner*—V. Millin

*Attorney, Agent, or Firm*—Schwartz & Weinrieb

[57] ABSTRACT

A liquid-filtered smoking device includes a container within which is disposed a liquid filter medium. Smoke is introduced into the device through one or more tubular members and is withdrawn therefrom, under inhalation conditions, through another tubular member. The lower end of the smoke-introducing tubular member is immersed within the liquid, and a hollow sphere is operatively associated therewith so as to serve as a float valve which permits the smoke to pass through the device under inhalation conditions and which becomes seated upon the smoke-introducing tubular member under non-inhalation conditions so as to prevent the surge or splash of the liquid upwardly within the smoke-introducing tubular member. The float and smoke-introducing tubular member can be integrated into a single unit or sub-assembly which can be utilized in conjunction with various liquid-filtered smoking devices.

14 Claims, 2 Drawing Figures

LIQUID-FILTERED SMOKING DEVICE HAVING LIQUID-SURGE PREVENTING MEANS INCORPORATED THEREIN

BACKGROUND OF THE INVENTION

1. Field of the Invention

The present invention relates generally to smoking devices, and more particularly to a liquid filtered smoking device which has water surge preventing means incorporated therein.

2. Description of the Prior Art

Prior art water pipes usually suffer from various disadvantages, such as, for example, the fact that they normally consist of one or more flexible hoses which have a considerable tendency to become clogged as a result of the smoke which passes therethrough, and particularly as a result of, for example, ash particles carried by such smoke. Such pipes are also normally quite difficult to maintain and clean, and consequently, they must often by discarded after being used for a relatively short period of time. In addition, the structure of such pipes is normally quite complex, and the same are operatively inefficient, particularly when it is desired to employ such pipes for the smoking of rare and expensive tobaccos.

In addition, prior art smoking devices of the aforenoted type have conventionally been of considerable size and bulky in configuration, and consequently, such factors militate against the ready portability of such devices. Still further, as a result of the complex structure of such devices, the structure of such smoking devices is necessarily rigidified, that is, the structural characteristics of a particular device is not normally capable of being incorporated into and within another smoking device.

Still yet further, it has also been observed in connection with prior art water pipes that due to the variance in the prevailing pressure within the devices during inhalation and non-inhalation operative periods, water tends to surge and splash backwards and upwards toward the smoking bowl portion of the device. Such water causes smoke to exit outwardly from the smoking bowl and the device, and in addition, also tends to wet the smoking bowl structure, such results of course being deleterious to the smoking operation of the device and therefore undesirable.

OBJECTS AND SUMMARY OF THE INVENTION

Accordingly, it is a significant object of the present invention to provide a new and improved smoking device.

Another object of the present invention is to provide a new and improved liquid-filtered smoking device.

Still another object of the present invention is to provide a new and improved liquid-filtered smoking device which overcomes the various drawbacks and disadvantages of prior art smoking devices.

Yet another object of the present invention is to provide a new and improved liquid-filtered smoking device which is easy to clean.

Yet still another object of the present invention is to provide a new and improved liquid-filtered smoking device which is simplified in structure and which permits the various structural parts thereof to be readily interchanged and replaced.

A further object of the present invention is to provide a new and improved liquid-filtered smoking device which is sturdy and rugged in construction.

A still further object of the present invention is to provide a new and improved liquid-filtered smoking device which is readily portable and adaptable to efficient shipment in bulk.

A yet further object of the present invention is to provide a new and improved liquid-filtered smoking device which incorporates therein means for preventing the surge and splashing of the liquid during non-inhalation operative periods and immediately subsequent to the completion of an inhalation period as a result of the variance in the pressure prevailing within the device during such non-inhalation and inhalation periods.

A still yet further object of the present invention is to provide a new and improved liquid-filtered smoking device which incorporates therein liquid surge-and-splash-preventing assembly which may be readily adaptable to various smoking devices.

An additional object of the present invention is to provide new and improved liquid-filter smoking device which utilizes a reversible smoking bowl which is capable of retaining a smaller or larger amount of tobacco therein.

A yet additional object of the present invention is to provide a new and improved liquid-filtered smoking device which is particularly well-suited for the purpose of smoking rare and expensive tobacco.

The foregoing and other objects are achieved in accordance with the present invention through the provision of a liquid-filtered smoking device which includes a container for housing the filter medium, such as, for example, water, wine or the like, one or more tubular members operatively associated with the container for introducing the smoke thereinto and a similar tubular member operatively associated with the container for withdrawing the smoke therefrom, and a flotatable member submerged within the filter medium and operatively associated with the lower, submerged end of the smoke introducing tubular member. The diameter of the flotatable member is larger than that of the smoke introducing tubular member, and within one embodiment of the present invention, the flotatable member is adapted to be interposed between the lowermost end of the smoke-introducing tubular member and the base of the filter medium container in a free-floating manner so as to alternately open or close the tubular member in order to permit the inhalation and withdrawal of smoke from the tubular member or to prevent surgence or splashing of the liquid upwardly within the tubular member, respectively, depending upon the prevailing pressure conditions within the container as dictated by the inhalation or non-inhalation operative periods.

In accordance with another embodiment of the present invention, the smoke introducing tubular member and the flotatable member are integrally assembled within a compact unit or sub-assembly which may be utilized in conjunction with various different liquid-filtered smoking devices or water pipes. In particular, a smoking bowl, which may, for example, be reversible, is mounted upon one end of the tubular member, while a cup-shaped cap is mounted upon the other end of the tubular member. As the diameter of the flotatable member, which may, for example, be a hollow sphere resembling a conventional ping-pong ball, is larger than that of the tubular member, the lower end of the tubular member, in conjunction with the cup-shaped cap, defines a closed chamber within which the flotatable member may be freely disposed so as to alternately open and close the tubular member when such end of the sub-assembly is submerged within the liquid of the smoking device and the pressure thereof varies depending upon the existence of inhalation or non-inhalation conditions.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference numerals designate like or corresponding parts throughout the several views, and wherein.

DETAILED DESCRIPTION OF THE ILLUSTRATED EMBODIMENTS

Figure 1:
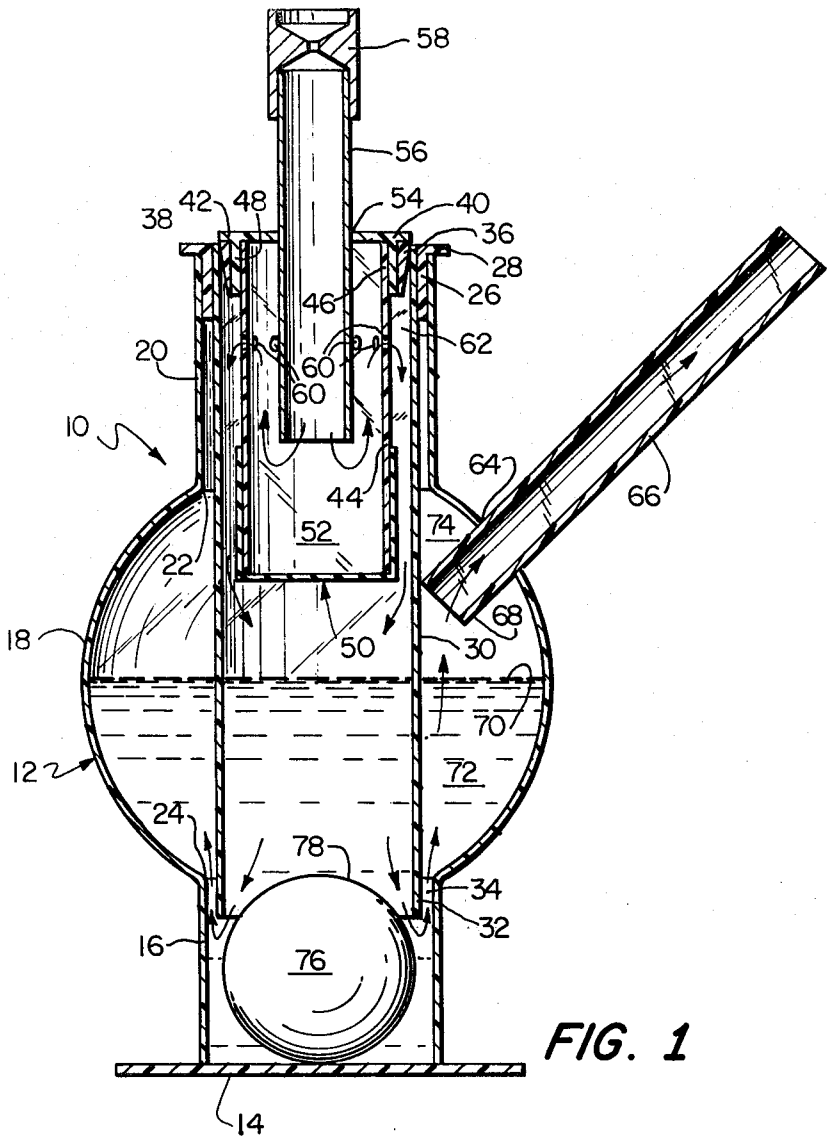
FIG. 1 is a cross-sectional view of a liquid-filtered smoking device constructed according to the present invention and showing its cooperative parts.

Referring now to the drawings, and more particularly to FIG. 1 thereof, there is shown a first embodiment of a liquid-filtered smoking device constructed in accordance with the present invention and generally indicated by the reference character 10. The device 10 includes a hollow container, generally indicated by the reference character 12, which, in turn, comprises a base plate 14, which may, for example, have a square-type configuration, a lower, hollow cylindrical portion 16 integrally secured to base plate 14, a central, hollow, substantially spherical portion 18 integrally secured to the upper portion of cylinder 16, and an upper, hollow, cylindrical portion 20 integrally secured atop the spherical portion 18, the upper end of portion 20 being open. Spherical portion 18 is of course provided with upper and lower apertures 22 and 24, the diameters of which correspond to those of the cylindrical portions 20 and 16, respectively, so as to permit fluidic communication between cylindrical portions 20 and 16, and spherical portion 18.

A tubular spacer 26 is disposed within the upper, open end of cylindrical portion 20 of container 12, by means of, for example, a friction-type fitting, and spacer 26 is also provided with a radially outwardly projecting annular flange 28 which is adapted to seat upon the uppermost end surface of portion 20 so as to fix the axial placement of spacer 26 relative to container 12. A tubular member 30, open at both ends thereof, is similarly disposed within spacer 26 by means of a friction fitting defined between the latter and the upper end of member 30, the lower end of member 30 projecting downwardly within cylindrical portion 16 of container 12 with the lowermost end 32 of member 30 being spaced a considerable distance from base plate 14. The diameter of tubular member 30 is also seen to be less than that of cylindrical portions 16 and 20 of container 12, and as a result of the dispostiion of member 30 with respect to container 12, as defined by spacer 26, an annular fluid passageway 34 is defined between the lowermost end 32 of member 30 and cylindrical portion 16 of container 12.

A second, annular, substantially frusto-conical spacer 36 is removably disposed and seated interiorly within the uppermost end 38 of tubular member 30, and a cup-shaped cap 40, closed at the upper end thereof, is disposed interiorly of spacer 36 by means of a friction-type fitting. Similar to spacer 26, cap 40 has a radially outwardly projecting annular flanged portion 42 which is seated upon the uppermost surface of spacer 36 so as to define the relative axial dispostion of cap 40 with respect to spacer 36. A tubular member 44, similar to tubular member 30, is disposed interiorly of cap 40 and supported thereby by means of a friction-type fitting defined between the uppermost end portion 46 of member 44 and the downwardly projecting skirt portion 48 of cap 40. A second, cup-shaped cap 50, closed at the lower end thereof, is similarly disposed upon the lower open end of tubular member 44, and thus, caps 40 and 50 serve to define a closed chamber 52 within tubular member 44.

Cap 40 is provided with a central aperture 54 through which extends another tubular member 56 open at both ends thereof, the lower end of member 56 projecting into chamber 52, while the upper end thereof projects upwardly from the device 10. A smoking bowl 58, which may, for example, be a reversible type smoking bowl as more specifically disclosed within U.S. Pat. No. 3,863,646, is removably mounted upon the uppermost end of tubular member 56, and in this manner, as may be readily appreciated, smoke from the tobacco disposed within bowl 58 may enter the device 10 through means of tubular member 56. A plurality of apertures 60 are disposed circumferentially about the upper portion of tubular member 44 in an equispatial manner, and in this manner, the smoke entering chamber 52 from tubular member 56 may then enter the lower portion of tubular member 30, it being appreciated that an annular chamber 62 is defined between tubular member 44 and the upper portion of tubular member 30 as a result of the disposition of tubular member 44 within member 30 as defined by spacer 36.

The central portion 18 of container 12 is also provided with an aperture 64 through which there is removably disposed an additional tubular member 66 open at both ends thereof, the lower end 68 of member 66 being disposed interiorly of container 12 and above the level 70 of the liquid 72 within container 12, the liquid being, for example, water, wine, or the like, while the upper end of member 66 projects outwardly of the device 10. In use, a smoker will place his mouth about the upper end of member 66 and upon inhaling, smoke from bowl 58 and tubular members 56, 44, 30 will enter liquid 72 and traverse the lower portion of member 30 as well as annular chamber 34. The smoke will then continue to rise upwardly within liquid 72, and upon exiting therefrom at liquid level 70, will enter tubular member 66 so as to enter the user's mouth. It will be further appreciated that as the flowpath of the smoke through concentric tubular members 56, 44 and 30 is defined in a serpentine manner, as best seen from the designated arrows, cap 50 also serves as an ash receptacle for any ash particles entrained within the smoke flowing through such members of the device, and in this manner, such particles may, in effect, be trapped within cap 50 as a result of falling thereinto under the influence of gravity, and consequently, the same will not be carried into liquid 72 so as not to contaminate the same.

In using the aforedescribed smoking device, during an inhalation operative period, vacuum conditions are, in effect, created within tubular member 66 and the annular area 74 defined by central portion 18 of container 12, tubular member 30, and liquid 72. At the completion of such an inhalation period, and therefore, during a non-inhalation period during which, for example, the smoker has removed his mouth from the outer or upper end of tubular member 66, the pressure within member 66 and annular chamber 74 returns to atmospheric, and as a result, the liquid 72 will normally surge or splash upwardly within tubular member 30 so as to adversely affect the seated arrangement of the tubular member 44, cap 40, member 56, and bowl 58 relative to the remaining structure of the device 10. Still further, smoke is also caused to revert backwardly into members 44 and 56 so as to similarly adversely affect the burning of the tobacco within bowl 58.

In order to therefore prevent the occurrence of such phenomena, a flotatable member 76, such as, for example, a hollow sphere of the ping-pong ball type, is interposed in a free-floating manner, between the lower end portion 32 of tubular member 30 and base plate 14 so as to, in effect, serve as a float-valve. The diameter of ball 76 is greater than that of tubular member 30 such that the ball 76 cannot entirely enter member 30 and can in fact block or close the lower end of member 30 by becoming seated therein under particular pressurized conditions. More particularly, during an inhalation period, the vacuum conditions created within chamber 74 serve to unseat ball 76 from tubular member 30, to the position shown in FIG. 1, whereby smoke is permitted to exit from member 30 and enter annular chamber 34, while during a non-inhalation period, atmospheric pressure conditions within chamber 74 and the floatability thereof serve to re-seat ball 76 within the bottom opening of tubular member 30 so as to close the same. In this manner, surgence and splashing of the liquid 72 upwardly within tubular member 30 is prevented. It is also to be appreciated that the diameter of ball 76 is predetermined with respect to the diameter of tubular member 30 as well as the distance between the lowermost end of member 30 from base plate 14 so as to permit ball 76 to become seated or unseated, under free-floating conditions, with respect to member 30, while the upper portion 78 of ball 76 is always maintained within the lower portion 32 of tubular member 30 so as to always insure the proper orientation and operation of the same.

Figure 2:
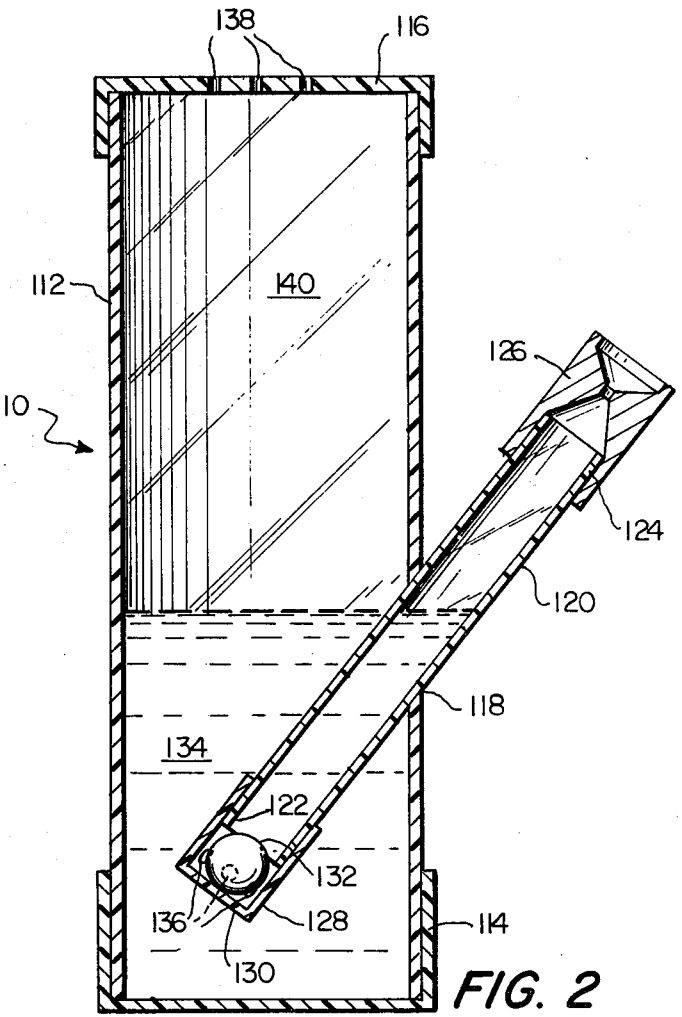
FIG. 2 is a view similar to that of FIG. 1, showing however, another embodiment of the present invention wherein a liquid surge-and-splash-prevention sub-assembly, constructed in accordance with the present inventon, may be incorporated into an exemplary liquid-filtered smoking device.

Referring now to FIG. 2, a second embodiment of the present invention is disclosed wherein the device 10 is seen to include a hollow, cylindrical container 112 which is open at both ends thereof, a first cup-shaped cap 114 being disposed upon the lower portion of container 112 by means of, for example, a friction-type fitting, while a second cup-shaped cap 116 is similarly disposed upon the upper portion of container 112. An aperture 118 is formed within a sidewall portion of container 112 and a tubular member 120, open at both ends thereof, is inserted through aperture 118 such that the lower end 122 of member 120 is disposed inwardly of container 112 while the upper end 124 of member 120 projects outwardly of the device 10. A reversible smoking bowl 126, similar to bowl 58, is removably disposed upon the upper end 124 of member 120, and a cup-shaped cap 128 is disposed upon the lower end 122 of member 120 by means of, for example, a friction fitting. The bottom portion 130 of cap 128 is disposed relative to the lower end 122 of member 120, in a manner similar to the disposition of base plate 14 relative to the lower portion 32 of member 30 of the embodiment of FIG. 1, so as to be able to accommodate a ball-type flotatable member 132 therebetween. It may thus be appreciated that bowl 126, tubular member 120, cap 128 and ball 132 constitute an integral sub-assembly which may be accommodated within variously configured smoking devices 10.

A liquid 134 is of course also accomodated within container 112, with the lower end 122 of member 120, cap 128 and ball 132, immersed therein, and in order to permit fluidic communication between container 112 and tubular member 120, the lower sidewall portion of cap 128 is provided with a plurality of openings or apertures 136 disposed circumferentially thereabout in an equispatial manner. Similarly, cap 116 is also provided with a plurality of holes or apertures 138, and in use, the smoker inserts his mouth over cap 116 and inhales. Vacuum conditions are, in effect, created within chamber 140 defined within container 112 and above liquid 134, as a result of which ball 132 is unseated from the lower portion 122 of member 120 so as to permit the smoke from bowl 126 and member 120 to enter that portion of liquid 134 disposed within member 120, pass through apertures 136, and enter the main body of liquid 134. The smoke then continues upwardly within liquid 134, exits therefrom, and enters chamber 140 so as to pass through apertures 138 and thereby enter the smoker's mouth. Upon completing the inhalation, and under non-inhalation conditions, atmospheric pressure within chamber 140 causes ball 132 to be reseated within the lower end 122 of member 120, and consequently, surging and splashing of the liquid upwardly within member 120 is prevented.

Obviously, many modifications and variations of the present invention are possible in light of the foregoing teachings. It is to be understood therefore that within the scope of the appended claims, the present invention may be practiced otherwise than as specifically described herein. ACCORDINGLY,

What is claimed is:

1. A liquid-filtered smoking device for smoking of rare and expensive tobaccos, comprising:

a container for housing a volume of liquid;

first means operatively associated with a first portion of said housing for introducing smoke into said housing and said liquid disposed therein;

second means, operatively associated with a second portion of said housing, for creating vacuum conditions therewithin and thereby withdrawing smoke from said liquid and said housing during an inhalation period, and being subjected to atmospheric conditions during non-inhalation periods and thereby impressing said atmospheric conditions upon said second portion of said housing and said liquid during said non-inhalation periods; and float valve means operatively associated with a portion of said first means and immersed within said liquid wherein said float valve means has a specific gravity less than said liquid and responsive to the existence of said vacuum or atmospheric pressure conditions at said second means, or for preventing the backward surge or splashing of said liquid into said first means, respectively.

2. A liquid-filtered smoking device as set forth in claim 1, wherein:

said first means is partially within said liquid.

3. A liquid-filtered smoking device as set forth in claim 2, wherein:

said first means includes a tubular member operatively supported upon said container, the lower portion of said tubular member being open and immersed within said liquid; and said float valve is a hollow sphere interposed between the lower end of said tubular member and a base portion of said container.

4. A liquid-filtered smoking device as set forth in claim 3, wherein:

the diameter of said sphere is larger than that of said tubular member so as to permit the sphere to be seated upon the lower open end of said tubular member.

5. A liquid-filtered smoking device as set forth in claim 1, wherein said first means comprises:

means defining a serpentine flowpath for said smoke; and means defining an ash receptacle disposed within said serpentine flowpath.

6. A liquid-filtered smoking device as set forth in claim 5, wherein said serpentine flowpath means comprises:

a plurality of three concentrically disposed tubular members.

7. A liquid-filtered smoking device as set forth in claim 6, wherein:

the bottom of said innermost tubular member is disposed above the bottom of said centrally disposed tubular member so as to define a smoke-conducting chamber therebetween;

said centrally disposed tubular member is provided with a plurality of apertures disposed circumferentially about the upper portion thereof for fluidically connecting said smoke-conducting chamber with said outermost tubular member; and said ash receptacle means is a cup-shaped cap secured upon the bottom end of said centrally disposed tubular member and serving to define said smoke-conducting chamber along with said innermost and centrally disposed tubular members.

8. A liquid-filtered smoking device as set forth in claim 1, further comprising:

a reversible smoking bowl mounted upon said first means.

9. A sub-assembly for preventing the backward surge or splashing of a liquid within a liquid-filtered smoking device during non-inhalation periods and following an inhalation period, comprising:

means for introducing smoke into said device and said liquid contained therein; and float valve means operatively associated with said smoke-introducing means wherein said float valve means has a specific gravity less than said liquid and responsive to the existence of vacuum or atmospheric pressure conditions within said device for permitting the flow of smoke from said smoke-introducing means into said device or for preventing the backward surge or splashing of said liquid into said smoke-introducing means, respectively.

10. A sub-assembly as set forth in claim 9, wherein:

said smoke-introducing means comprises a tubular member, the lower end of which is adapted to be immersed within said liquid of said device; and said float valve means operatively associated with said portion of said tubular member immersed within said liquid.

11. A sub-assembly as set forth in claim 10, further comprising:

a cup-shaped cup fixedly secured upon the lower end of said tubular member; and said float valve is a hollow sphere interposed between the bottom of said cap and the lower end of said tubular member.

12. A sub-assembly as set forth in claim 11, wherein:

the diameter of said sphere is larger than that of said tubular member so as to permit said sphere to be seated upon the lower end of said tubular member.

13. A sub-assembly as set forth in claim 9, further comprising:

a reversible smoking bowl mounted upon said smoke-introducing means.

14. A sub-assembly as set forth in claim 11, wherein:

a plurality of apertures are formed within said cap so as to permit said tubular member to be fluidically communicated with said device and said liquid therein.

* * * * *